United States Patent [19]

Wolf

[11] 3,939,644

[45] Feb. 24, 1976

[54] CIRCUIT ARRANGEMENT FOR CONTROLLING THE RUNNING OF A QUARTZ-CONTROLLED ELECTRIC CLOCK

[75] Inventor: Hans-Peter Wolf, Horkheim, Germany

[73] Assignee: Licentia Patent-Verwaltungs-G.m.b.H., Frankfurt am Main, Germany

[22] Filed: June 25, 1974

[21] Appl. No.: 483,072

[30] Foreign Application Priority Data

June 25, 1973 Germany ..... 2332237

[52] U.S. Cl. ..... 58/23 R; 58/23 A; 58/23 AC; 58/85.5

[51] Int. Cl.[2] ..... G04C 3/00; G04B 27/08

[58] Field of Search ..... 58/28 R, 85.5, 23 R, 23 A, 58/23 BA, 23 AC, 23 D, 34; 331/116 M; 318/119

[56] References Cited

UNITED STATES PATENTS

| | | | |
|---|---|---|---|
| 3,526,088 | 9/1970 | Meitinger | 58/28 R |
| 3,690,058 | 9/1972 | Kurita | 58/23 R |
| 3,691,753 | 9/1972 | Kurita | 58/85.5 X |
| 3,745,758 | 7/1973 | Kuritz | 58/85.5 X |
| 3,762,153 | 10/1973 | Komiyana et al. | 58/85.5 X |
| 3,813,873 | 6/1974 | Nakagawa | 58/85.5 |

*Primary Examiner*—L. T. Hix
*Assistant Examiner*—U. Weldon
*Attorney, Agent, or Firm*—Spencer & Kaye

[57] ABSTRACT

A circuit arrangement for an electric clock comprises an oscillator stage, frequency divider stages, pulse shaper stages and two output stages for controlling the drive, switch means being provided which is operable to disconnect at least part of the oscillator stage and the two output stages from a voltage source so as to stop the oscillator and prevent the output stages from driving a drive motor.

4 Claims, 3 Drawing Figures

CIRCUIT ARRANGEMENT FOR CONTROLLING THE RUNNING OF A QUARTZ-CONTROLLED ELECTRIC CLOCK

BACKGROUND OF THE INVENTION

The invention relates to a circuit arrangement for a quartz-controlled electric clock, comprising an oscillator stage, frequency divider stages, pulse shaper stages and two output stages (output buffers) for controlling the drive, wherein the stages are constructed with MIS (Metal-Insulator-Semiconductor) field effect transistors. The output stages are frequently known as output buffers. In this case it is a question of low-voltage electronic switches by which, after, in each case, for example, one second, the direction of rotation of the clock drive motor is changed.

SUMMARY OF THE INVENTION

It is an object of the invention to provide an arrangement by which, after the setting of the clock, the further running of the clock is ensured in a period of time which is as short as possible.

According to the invention, there is provided a circuit arrangement for a quartz-controlled electric clock comprising a voltage source, an oscillator stage, frequency divider stages connected to said oscillator stage, pulse shaper stages connected to said frequency divider stages, output stages connected to said pulse shaper stages, a drive motor connected to said output stages and a switch associated with said oscillator stage and said output stages operable to stop said oscillator stage from oscillating and prevent said output stages from running said drive motor by disconnection of at least part of said oscillator stage and said output stages from said voltage source.

Further according to the invention, there is provided a circuit arrangement for a quartz-controlled, electric clock, comprising an oscillator stage, frequency divider stages, pulse shaper stages and two output stages (output buffers) for controlling the drive, wherein the stages are built up with MIS field effect transistors, characterized in that a switch is provided by which, on setting the clock the controllable current path of at least one field effect transistor only in said oscillator stage and in said two output stages is disconnectable in such a manner from a supply voltage source that said oscillator stage no longer oscillates, and a motor connected to said output stage stops.

BRIEF DESCRIPTION OF THE DRAWINGS

The invention will now be described in greater detail, by way of example, with reference to the drawings, in which.

DESCRIPTION OF THE PREFERRED EMBODIMENT

Figure 1:
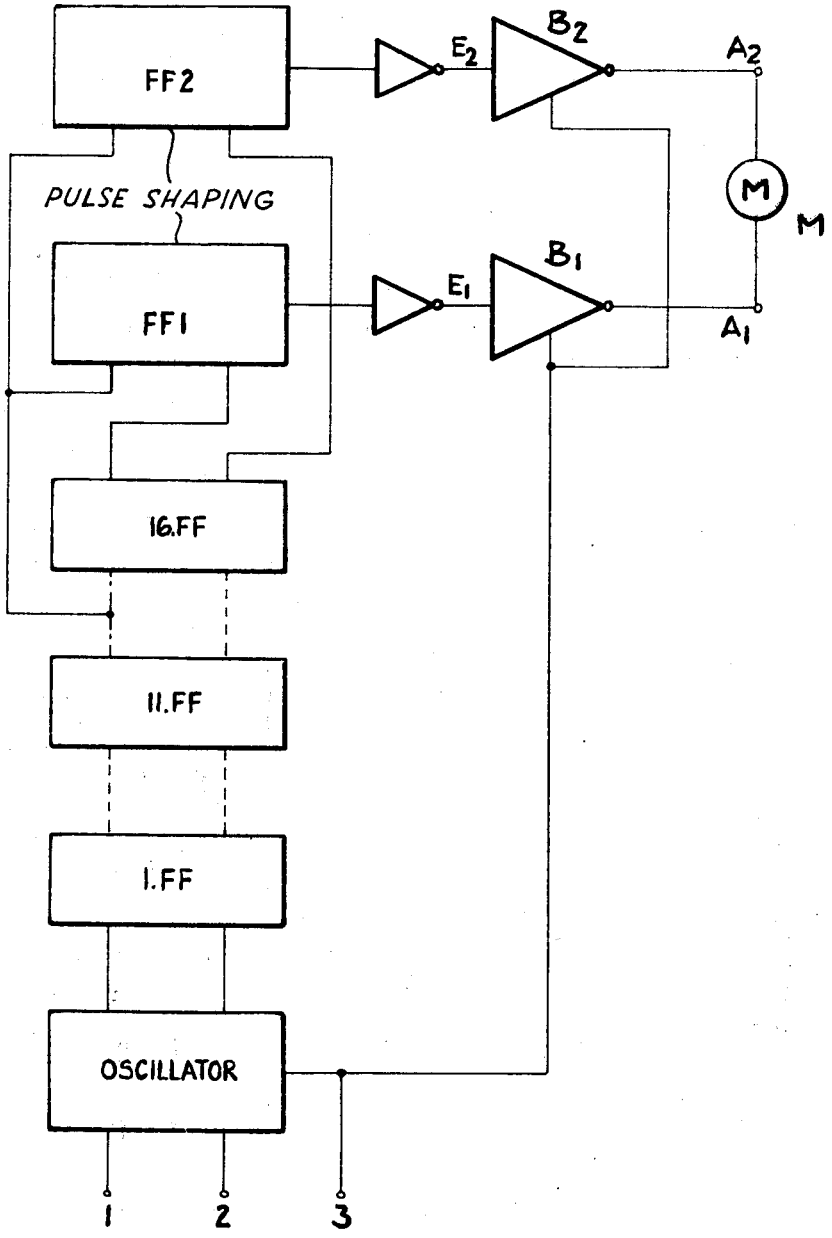
FIG. 1 shows the block circuit diagram of a electronic clock unit according to the invention.

Basically, in a preferred embodiment of the invention as applied to a circuit arrangement heretofore mentioned, the invention proposes that a switch is provided by which, on setting the clock the controllable current path of at least one field effect transistor is disconnectable from the supply voltage source only in the oscillator stage and in the two output stages in such a manner that the oscillator stage no longer oscillates and the motor connected to the output stage stops. By the controllable current path of a field effect transistor is understood the current path from the source electrode through the channel to the drain electrode.

In one form of embodiment, the switch is coupled to the setting mechanism in such a manner that on setting the clock the oscillator stage and the two output stages are automatically disconnected in the described manner from the supply voltage source. This means, in the case of a wrist-watch, that by pulling out the adjusting screw, the said circuit parts are separated from the supply voltage source and that, on resetting of the milled knob or adjusting screw into its initial position the circuit parts are again connected to the supply voltage sources.

The important advantage of the new circuit arrangement resides in the fact that the frequency divider stages and the pulse shaper stages are not disconnected from the supply voltage during the setting of the clock. The appropriate information in these circuit parts is thus retained during the setting time so that, after setting the clock, at most one second can pass before the clock runs again. If all the circuit parts were separated from the supply voltage source, the maximal starting time would amount to 2 seconds.

Referring now to the drawings, the circuit stages are constructed with MIS field effect transistors. These transistors have a control electrode insulated from the channel region. If the insulating layer comprises an oxide (e.g. $SiO_2$), then these transistors are MOS (Metal-Oxide-Semiconductor) transistors. The transistors operate according to the enrichment principle, i.e. that in the case of a zero control voltage, no current can flow between the source and the drain electrodes. Only in the case of a control voltage of a suitable size and polarity is the channel region inverted in its type of conductivity and a current can flow between the source and drain electrodes. On assembly of the circuit stages according to FIGS. 2 and 3 so called CMOS (Complementary Metal-Oxide-Semiconductor) transistors are used. In this case it is a question of a complementary pair of transistors in each case which is accommodated in a common semiconductor body and, if the circumstances permit, with other components. One of the transistors thus has a channel of n type conductivity, whereas the field effect transistor complementary thereto has a channel of p type conductivity in the conducting state. The substrates of these transistors are each connected to one pole of the supply voltage source in the manner shown.

In the block circuit diagram of FIG. 1 can be seen first the oscillator which is energized by a quartz crystal in manner known per se. Connected after the oscillator are sixteen frequency divider stages 1.FF to 16FF, after which follow two pulse shaper stages FF1 and FF2. These pulse shapers each emit a pulse every 2 seconds which are so displaced within the stages with respect to each other that output stages B1 and B2 are reversed every second and thus the current direction through the load resistance changes every second. The motor M therefore changes its direction of rotation in the case of an alternating driving current, in each case, after one second and takes up, in each case, one of its two preferred positions. In the case of a motor with only one direction of rotation, this motor is further rotated in each case, after 1 sec. by 180°.

The supply voltage is connected to the oscillator stage and additionally to the output stages at the point 3. This point 3 is connected by means of a switch K (FIG. 2) with the supply voltage source.

Figure 2:
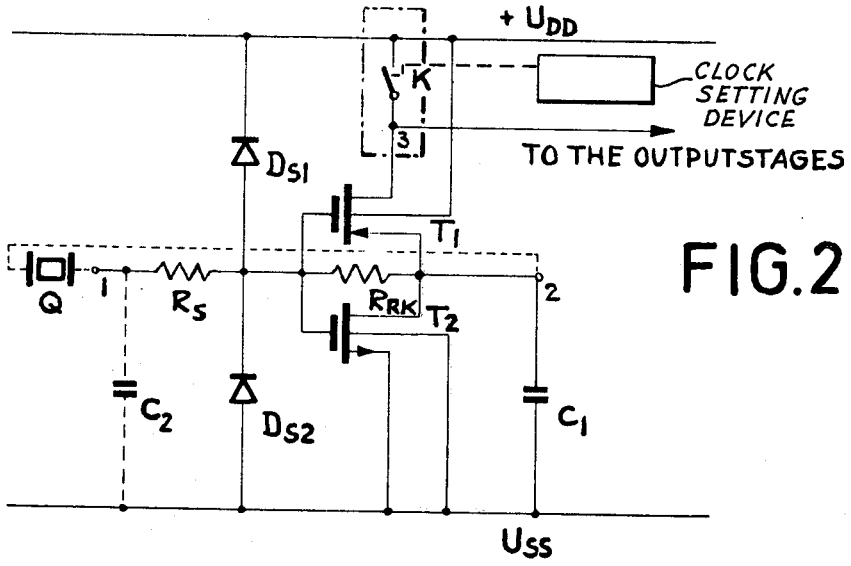
FIG. 2 shows the oscillator stage.

FIG. 2 shows the oscillator stage. It comprises essentially the two complementary CMOS transistors $T_1$ and $T_2$ connected in series with each other. The control electrodes are connected to each other and are connected by neans of the feedback resistance $R_{RK}$ to the output electrode 2. The diodes $D_{S1}$ and $D_{S2}$ are protecting diodes and are stressed in the reverse direction. Also the low value resistance $R_S$ serves as a protecting resistance. The quartz crystal Q and the capacitances $C_1$ and $C_2$ serve to produce the oscillations. In the case of a preferred form of embodiment, the transistors $T_1$ and $T_2$, the diodes $D_{S1}$ and $D_{S2}$, the resistance $R_S$ and the capacitance $C_1$ are accommodated in a single semiconductor body. The capacitance $C_2$ and the switch K and the crystal Q are connected in externally. The serially connected transistors are connected, in the operational stage of the circuit, to the positive supply voltage $U_{DD}$ by means of the closed switch K. If on setting the clock by operation of a clock setting device, the switch K is opened, the transistor $T_1$ is inverted, insofar as it is a p channel field effect transistor. The substrate of n type conductivity of this transistor is at the voltage $+U_{DD}$ and is connected by means of a pn junction stressed in each case in the reverse direction to the $p^+$conducting source and the drain electrode. The oscillator oscillation stops. Then still only the blocking currents of the transistor $T_1$ flow through the transistor $T_2$, which is an n channel field effect transistor, so that at the point 2, a very small voltage drop occurs. This voltage is interpreted as a logic o by the circuit stages connected thereafter. Since the frequency divider stages and the pulse shaper stages are not separated from the supply voltage $U_{DD}$, the information of these stages is retained.

Figure 3:
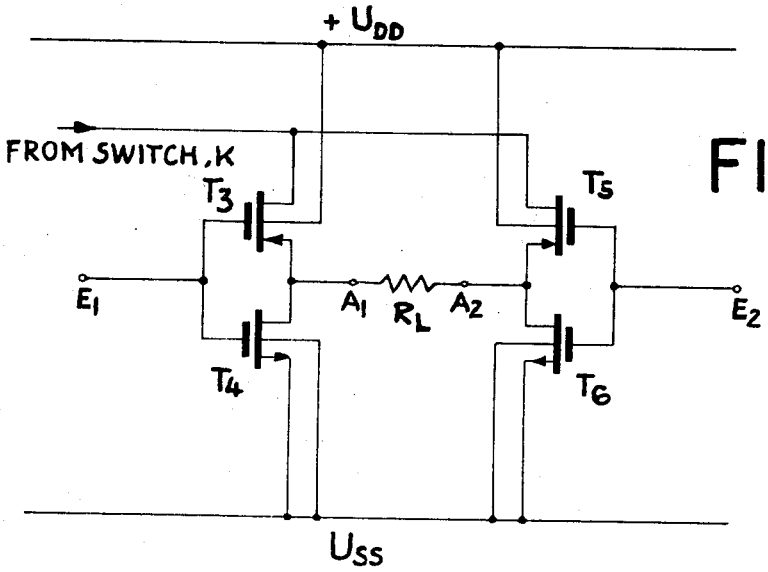
FIG. 3 shows the two output stages

FIG. 3 shows the two output stages which in each case comprise two CMOS transistors. The transistors $T_3$ and $T_5$ are, for example, p channel transistors, whereas the transistors $T_4$ and $T_6$ are n channel transistors. In the operational state, the source electrodes of the transistors $T_3$ and $T_5$ are connected by means of the closed switch K to the voltage $+U_{DD}$. There are then two switch states. If a positive pulse is applied to the input electrode $R_1$ i.e. a logic "1", no inversion layer can form in the channel region of the transistor $T_3$ and this transistor remains blocked. On the other hand, in the n channel transistor $T_4$, the surface region in the channel region between the two $n^+$— conducting drain and source electrodes is inverted to form an n conducting surface layer and a current can flow. Since at the input electrode $E_2$ a logic "0", is present the relationships are there reversed. The transistor $T_5$ is conductive, the transistor $T_6$ is blocked. A current can flow through the transistors $T_5$ and $T_4$ thus through the resistance $R_L$ from $A_2$ and $A_1$. If a logic 0 is applied to $E_1$ and at $E_2$ a logic 1 is applied, this is a second after the above described state, the hitherto blocked transistors are conductive and the hitherto conducting transistors are blocked. Then a current from $A_1$ and $A_2$ flows through the transistors $T_3$ and $T_6$ and through the load resistance $R_L$. The current direction thus changes and causes a change in the direction of rotation of the motor M (FIG. 1).

If the switch K is open, three possible output states can be distinguished. If the voltage at both input electrodes $E_1$ and $E_2$ is just 0, after the opening of the switch k all the transistors are blocked and no current can flow through $R_L$.

If the voltage at $E_1$ is 0 and at $E_2$ 1 — just as in the case of the reversed voltage relationships — the above two transistors $T_3$ and $T_5$ are always blocked so that in no case, dependent on the operational state of the two lower transistors $T_4$ and $T_6$, can a noticeable current flow through $R_L$. The output stages are thus adjusted during the setting time. After the end of the setting operation the output stage receives at the latest after one second the correct information for the further running of the motor, i.e. the information which failed to be supplied during the interruption of the motor. In this way the setting time can then be reduced to a minimum.

It will be understood that the above description of the present invention is susceptible to various modification changes and adaptations.

What is claimed is:

1. In a circuit arrangement for a quartz-controlled electric clock which can be set, the circuit arrangement including a supply voltage source, a motor, an oscillator stage, frequency divider stages connected to said oscillator stage, pulse shaper stages connected to said frequency divider stages, and two output stages connected to said pulse shaper stages for controlling the drive of the motor, at least the oscillator stage and each output stage each being composed of at least one Metal-Insulator-Semiconductor field effect transistor having a controllable current path, the improvement comprising a switch arranged to be operated during setting of the clock and connected to the controllable current paths of said transistors only in said oscillator stage and said two output stages for disconnecting said current paths from the supply voltage source, in order to terminate oscillation of said oscillator stage and stop said motor whereby said voltage source remained connected to said frequency divider stages during setting of the clock.

2. A circuit as defined in claim 1 wherein the clock is provided with a setting mechanism by which it can be set and said switch is coupled to the setting mechanism in such a manner that on setting the clock, the oscillator stage and the two output stages are automatically disconnected from the supply voltage source.

3. A circuit arrangement as defined in claim 1, wherein the oscillator stage and the output stages are constructed with complementary MOS field effect transistors.

4. A circuit arrangement for a quartz controlled electric clock comprising a voltage source, an oscillator stage, frequency divider stages connected to said oscillator stage, pulse shaper stages connected to said frequency divider stages, output stages connected to said pulse shaper stages, a drive motor connected to said output stages, and a switch connecting said oscillator stage and said output stages to said voltage source and arranged to open to stop said oscillator stage from oscillating and prevent said output stages from running said drive motor by disconnection of at least part of said oscillator stage and said output stages from said voltage source whereby said frequency divider stages remain connected to said voltage source.

* * * * *